US008857845B2

(12) United States Patent
Ohlheiser

(10) Patent No.: US 8,857,845 B2
(45) Date of Patent: Oct. 14, 2014

(54) SNOWBOARD BINDING LOCKING LEVER PULL CABLE

(76) Inventor: Todd Ohlheiser, Lafayette, CO (US)

( * ) Notice: Subject to any disclaimer, the term of this patent is extended or adjusted under 35 U.S.C. 154(b) by 108 days.

(21) Appl. No.: 13/564,537

(22) Filed: Aug. 1, 2012

(65) Prior Publication Data

US 2012/0292887 A1 Nov. 22, 2012

Related U.S. Application Data

(60) Provisional application No. 61/592,496, filed on Jan. 30, 2012.

(51) Int. Cl.
*A63C 9/00* (2012.01)
*A63C 10/24* (2012.01)
*A63C 10/04* (2012.01)

(52) U.S. Cl.
CPC ..... *A63C 10/045* (2013.01); *A63C 10/24* (2013.01)
USPC ..... 280/611

(58) Field of Classification Search
USPC ..... 280/611–634
See application file for complete search history.

(56) References Cited

U.S. PATENT DOCUMENTS

| | | | | |
|---|---|---|---|---|
| 5,556,123 | A | 9/1996 | Fournier | |
| 5,997,027 | A | 12/1999 | Jungkind | |
| 6,003,893 | A | 12/1999 | Hansen | |
| 6,007,077 | A | 12/1999 | Moe | |
| 6,024,375 | A | 2/2000 | Johnson | |
| 6,065,770 | A | 5/2000 | Hansen | |
| 6,116,634 | A * | 9/2000 | Mometti | 280/613 |
| 6,276,708 | B1 * | 8/2001 | Hogstedt | 280/613 |
| 6,955,362 | B2 | 10/2005 | Bazzi | |
| 7,147,233 | B2 | 12/2006 | Edmund | |
| 7,232,132 | B2 | 6/2007 | Elkington | |
| 7,246,811 | B2 | 7/2007 | Martin | |
| 7,367,579 | B2 | 5/2008 | Elkington | |
| 7,516,976 | B2 | 4/2009 | Cunningham | |
| 7,694,994 | B2 | 4/2010 | Lang et al. | |
| 2004/0262887 | A1 | 12/2004 | Blanchi Bazzi | |
| 2005/0285372 | A1 | 12/2005 | Edmund | |
| 2006/0244241 | A1 | 11/2006 | Martin | |
| 2007/0045988 | A1 | 3/2007 | Doyle | |
| 2007/0045989 | A1 | 3/2007 | Cunningham | |
| 2007/0158929 | A1 | 7/2007 | Neiley | |
| 2008/0258434 | A1 | 10/2008 | Krenn | |
| 2010/0253021 | A1 * | 10/2010 | Kostantin | 280/11.33 |
| 2011/0131772 | A1 | 6/2011 | Caslowitz | |
| 2011/0254251 | A1 | 10/2011 | Jung | |

FOREIGN PATENT DOCUMENTS

| | | | |
|---|---|---|---|
| AT | 11065 | U1 | 4/2010 |
| DE | 19602667 | C1 | 10/1997 |
| DE | 102007017575 | A1 | 10/2008 |
| EP | 0958846 | A1 | 5/1998 |

(Continued)

*Primary Examiner* — John Walters
*Assistant Examiner* — James Triggs
(74) *Attorney, Agent, or Firm* — Will Hunziker

(57) ABSTRACT

The present disclosure is directed generally towards closing a snowboard binding locking lever with a pull cable that protrudes forward, upward, or upward and forward from the highback of the binding. One aspect of the present disclosure provides a pull cable with a cable guide and a grip. Another aspect includes a semi-rigid bendable guide to act as an additional guide for the pull cable. Another aspect includes a magnet or notch to fasten the grip towards the front of the binding.

18 Claims, 5 Drawing Sheets

(56) References Cited

FOREIGN PATENT DOCUMENTS

| | | | |
|---|---|---|---|
| EP | 0908206 | A1 | 4/1999 |
| JP | 8206275 | A | 8/1996 |
| JP | 10076040 | A | 3/1998 |
| JP | 11187901 | | 7/1999 |
| WO | WO9731687 | A1 | 9/1997 |
| WO | WO9814247 | A | 4/1998 |
| WO | WO2009066029 | A2 | 5/2009 |
| WO | WO2010112384 | A1 | 10/2010 |

* cited by examiner

SNOWBOARD BINDING LOCKING LEVER PULL CABLE

CROSS-REFERENCE TO RELATED APPLICATION(S)

This application is a nonprovisional patent application which claims the benefit of, and priority to, U.S. Provisional Patent Application No. 61/592,496, also entitled "SNOWBOARD BINDING LOCKING LEVER PULL CABLE," filed on Jan. 30, 2012, which is incorporated by reference herein in its entirety for all purposes.

BACKGROUND OF THE INVENTION

1. Field of the Invention

The field to which this invention pertains is snowboard bindings with rear-mounted locking levers.

2. Description of Related Art

Snowboards are well-known in the related art and in the sporting world, various types of bindings have been developed to allow the user to engage their boots to the snowboard.

Conventional snowboard binding systems used with soft snowboard boots are generally categorized as either strap bindings that typically include a rigid highback piece against which the heel of the boot is placed and one or more straps that secure the boot to the binding or step-in bindings that typically utilize one or more strapless engagement members into which the rider can step to lock the boot into the binding. Strap bindings are the original and most popular type of snowboard bindings and are adjustable, secure, and comfortable. Step-in bindings allow the user to more easily engage and disengage from the snowboard.

Both strap bindings and step-in bindings usually include a pivotable highback ankle support that extends upwardly from the snowboard. The back ankle portion of the rider's boot abuts against a curved forward surface of the highback, essentially providing leverage by which the rider can control the snowboard's heel edge. Appreciated is that a rider must typically engage and disengage the binding many times over the course of a day of snowboarding, generally, while the rider is on the slopes and, typically, with gloved hands. Unlike skiing, snowboarding requires the user to engage or disengage the rear-boot every time the rider gets on or off a lift. Thus, a rider consumes more of their time on the slopes engaging and disengaging his/her bindings. The binding is typically engaged and disengaged by using a lever disposed on the back of the highback. This lever can be difficult for the rider to grab, because its position in the unlocked position is very low in relation to the ground near the surface of the snowboard and behind the rider. Therefore, physically reaching to the end of the locking lever to engage the binding is difficult for the rider.

Because the rider must typically balance on his/her heels or toes to maintain stability on an sloping ski hill, maintaining balance while crouching low and reaching backwards to close the locking lever of a binding is exceptionally difficult. As such, many riders must sit down on a ski hill to close the locking lever of a binding. Related art, such as U.S. Pat. No. 7,246,811 to Martin, involve attached cords or straps to the locking lever in order to make closure of the rear-mounted lever easier. However, the related art fails to bring such cord or strap to the location where the user grasps the cord or strap to a position either forward, above, or forward and above the highback so that the snowboarder can easily reach such cord or strap while in a standing or crouched position. Thus, the rider is more likely to be forced to sit down on the slope.

SUMMARY

Accordingly, a long-felt need exists for a pull cable or strap to close the locking lever of a snowboard binding that allows a snowboarder to remain balanced from a standing or crouched position without causing the snowboarder to reach backwards or sit down. The subject matter of the present disclosure solves this problem by allowing the snowboarder to grasp a pull cable or strap from a grip that is situated in an elevated, forward, or elevated and forward position from the highback of the binding, thereby bringing the rear-mounted locking lever into a locking position while the snowboarder is in a standing or crouching position. The present disclosure is described with reference to popular snowboard bindings; however, the subject matter of the present disclosure encompasses many other applications involving bindings with rear-mounted locking levers. Some of the embodiments of the following invention are as follows.

In an embodiment of the present disclosure, a snowboard binding locking lever pull cable or strap is disclosed, the cable or strap comprising a semi-rigid pull cable or strap attached to the locking lever on a highback of a binding. A cable or strap guide is attached to the top half of the highback through which the semi-rigid pull cable or strap extends. The semi-rigid pull cable or strap has a grip on the opposite end from the attachment to the locking lever, which the cable or strap guide directs in a forward, upward, or forward and upward direction towards the snowboarder's downward reaching hand. When the snowboarder pulls the grip end of the semi-rigid pull cable or strap, the locking lever of the binding moves more easily from an open to a closed position.

In another embodiment of the present disclosure, the pull cable or strap is routed through a spring or other semi-rigid bendable guide that is attached to the upper portion of the highback such that the semi-rigid bendable guide extends forward from the highback of the binding and toward the grip end of the pull cable or strap. The semi-rigid bendable guide helps the pull cable or strap maintain either its upwards, forwards, or upwards and forwards orientation so that the grip remains in a convenient position for the snowboarder to access without sitting or reaching backwards. This semi-rigid bendable guide is an important addition to the present disclosure when the highback of the binding it is attached to pivots farther backwards and closer to the ground. The semi-rigid bendable guide can also help guide the boot of the snowboarder into the binding.

In another embodiment of the present disclosure, the semi-rigid bendable guide or spring is made with a bend or arch to help bring the grip of the pull cord or strap to an easier position to grasp. The arch shape can also bring the grip of the cord or strap toward a location where it can more easily be secured.

In another embodiment of the present disclosure, the semi-rigid bendable guide has a cover that enshrouds the semi-rigid bendable guide. The semi-rigid bendable guide cover has two openings coaxially aligned with the pull cable or strap that allow the pull cable or strap to pass into and out of the cover, and, therefore, the semi-rigid bendable guide as well. The cover allows the pull cable or strap to continue moving freely inside the semi-rigid bendable guide by protecting the semi-rigid bendable guide from becoming packed up with snow, ice, or mud.

In another embodiment of the present disclosure, the grip contains a magnetic element that attracts another magnetic element located on the front of the binding. This feature secures the pull cable so that it stays out of the way once the snowboarder has closed the locking lever and is riding. This magnetic attachment also allows the binding locking lever to be released without the need to release the pull cord or strap first.

In another embodiment of the present disclosure, the front of the binding contains a slot, inside which the grip of the pull cable or strap is designed to fit snuggly. This feature secures the pull cable so that it stays out of the way once the snowboarder has closed the locking lever and is riding. This prevents the pull cable from catching on objects on the ski-slope terrain and injuring the snowboarder.

In another embodiment of the present disclosure, a method is provided for pulling a rear-mounted binding locking lever closed from a location either forward, above, or forward and above the highback of the binding; and a feature for guiding the pulling element to a position where a user can grasp it without sitting down.

In another embodiment of the present disclosure, a method is provided, the method comprising: standing with the boot in the binding and the locking lever in an open position; bending to grasp the grip of a pull cable or strap without sitting down; pulling upwards on the grip of the pull cable or strap; and closing the rear-mounted lever located on the binding. In a further embodiment of the present disclosure, the method additionally includes securing the grip to the front of the binding.

In another embodiment of the present disclosure, the pull cable or strap can be made a part of the binding upon creation of the binding or it can be an additional attachment made to the binding after the original creation of the binding.

These and other needs are addressed by the various aspects, embodiments, and/or configurations of the present disclosure. Also, while the present disclosure is described in terms of exemplary embodiments, appreciated is that individual aspects of the disclosure can be separately practiced.

The present disclosure can provide a number of benefits depending on the particular aspect, embodiment, and/or configuration. None of the particular benefits that follow must be entirely satisfied, as they are non-exclusive alternatives and at least one of the following benefits is met. Accordingly, several benefits of the subject matter of the present disclosure are:

(a) providing a structure or feature for a user to bring the rear-mounted lever of a binding into a locked position with reduced physical effort;

(b) providing a structure or feature for a user to bring the rear-mounted lever of a binding into a locked position that is quicker and more efficient than current means;

(c) providing a structure or feature for a user to bring the rear-mounted lever of a binding into a locked position without leaning backwards;

(d) providing a structure or feature for a user to bring the rear-mounted lever of a binding into a locked position without having to sit or kneel down;

(e) providing a structure or feature for a user to bring the rear-mounted lever of a binding into a locked position by pulling upwards or forward from the user's center of gravity;

(f) providing a structure or feature for a user to bring the rear-mounted lever of a binding into a locked position that is easier to reach from an upright position, while in motion, or while the snowboard is sliding forward; thus giving the rider the ability to close the locking lever of the binding at the top of every ski lift without slowing down; allowing the snowboarder to function like a skier that does not have to stop and fasten a binding;

(g) providing a structure or feature for a user to bring the rear-mounted lever of a binding into a locked position that can be used and reused on multiple bindings;

(h) providing a structure or feature for a user to bring the rear-mounted lever of a binding into a locked position that can also be used as a means to carry a snowboard comfortably;

(i) providing a structure or feature for a user to guide a boot into a binding by following semi-rigid bendable guide; and (j) these and other benefits of the subject matter of the present disclosure will become apparent from the following description, taken in conjunction with the accompanying drawings, wherein are set forth, by way of illustration and example, certain embodiments of the subject matter of the present disclosure. The drawings constitute a part of this specification and include exemplary embodiments of the subject matter of the present disclosure and illustrate various benefits and features thereof.

DETAILED DESCRIPTION

Figure 1:
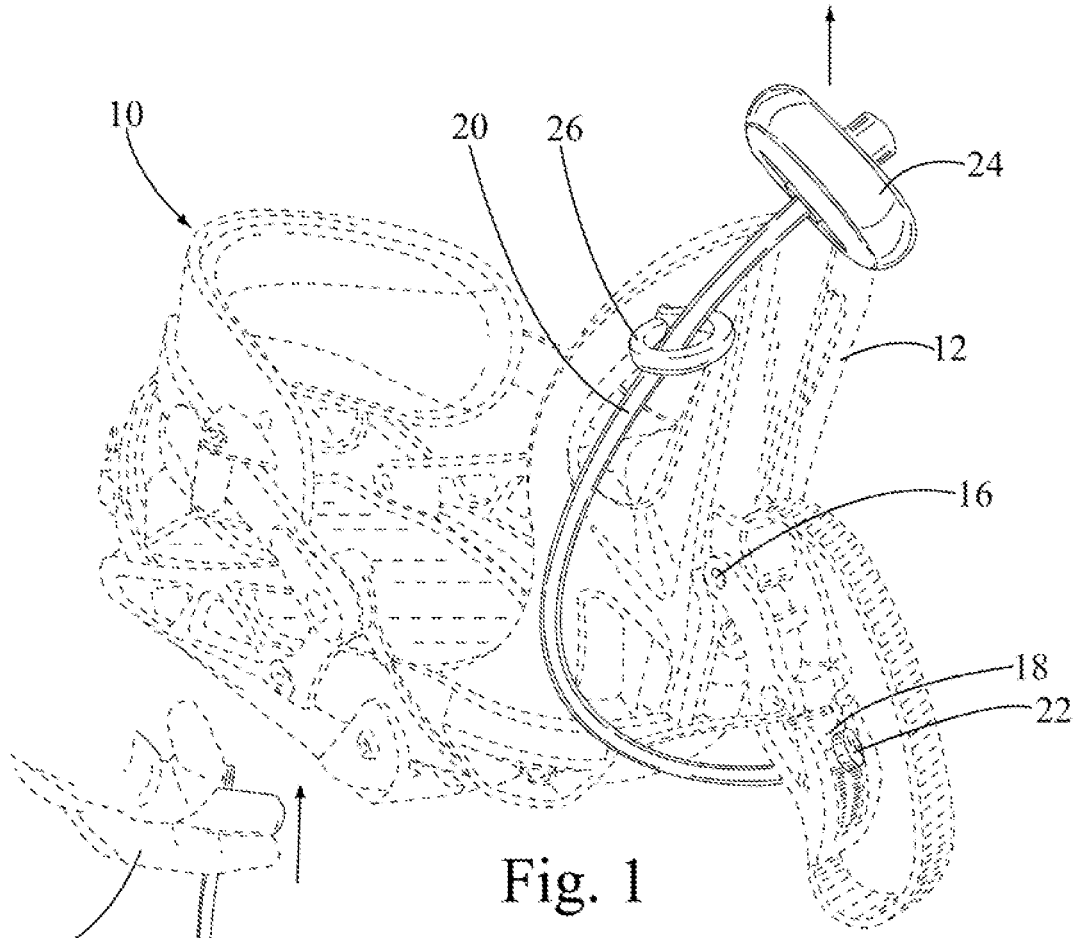
FIG. 1 is a diagram that illustrates an isometric perspective view of a step-in snowboard binding with rear-mounted lever in the unlocked position with a pull cable, according to an embodiment of the present disclosure.

For the purposes of promoting an understanding of the principles of the present disclosure, reference will now be made to the embodiments illustrated in the drawings and specific language will be used to describe the same. However, the illustrated embodiments are merely exemplary and many additional embodiments of the present disclosure are possible. For example, a snowboard binding is pictured; however, the subject matter of the present disclosure can be applied to any binding attaching a boot to a sports gear with a rear-mounted locking lever. Understood is that no limitation of the scope of the present disclosure is thereby intended. Any alterations and further modifications in the illustrated devices, and such further application of the principles of the present disclosure, as illustrated herein are contemplated as would normally occur to one skilled in the art to which the present disclosure relates, are also encompassed by the present disclosure.

Unless otherwise indicated, the drawings are intended to be read (e.g., arrangement of parts, proportion, degree, etc.) together with the specification, and are to be considered a portion of the entire written description of the present disclosure. As used in the following description, the terms "horizontal," "vertical," "left," "right," "up," and "down"; as well as adjectival and adverbial derivatives thereof (e.g., "horizontally," "rightwardly," "upwardly," etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

1. The Locking Lever Pull Cable

Shown throughout the figures, the present disclosure generally describes a pull cable attached to a rear-mounted locking lever of a snowboard binding.

Referring to FIG. 1, this a diagram illustrates a perspective view of a common step-in type snowboard binding with a front toe section (10) and a rear-mounted lever (14) in the unlocked position, in accordance with an embodiment of the present disclosure. The step-in snowboard binding has a highback (12) that has a locking lever (14) with an aperture (18) that works about a pivot (16) in the vertical direction. A pull cable (20), cord, rope, pull, strap or equivalent is attached to the locking lever (14). Such attachment may be by any means of securely preventing the pull cable (20) from detaching from the locking lever (14): as shown the structure for attachment of the pull cable or strap is a protrusion that may be a crimp (22) applied to the end of the pull cable (20) that prevents the pull cable from pulling through an aperture in the locking lever (18). The end of the pull cable (20) that is distal from the locking lever may have a grip (24), handle, pull, loop, or similar functional element that can allow the user of the binding to conveniently grasp the pull cable (20). The pull cable (20) then threads through a cable guide (26) that is either molded into, attached directly to, or a drilled into the highback (12) of the binding in a position that is off-center from the vertical axis of the highback (12) and above the attachment of the pull cable (20) to the locking lever (14). The cable guide (26) can be a part of, or mounted to, either side or the center of the top of the highback. The cable guide (26) can be made of any material suitable for its purpose, which is preferably plastic or metal; and made in any arrangement that allows the pull cable (20) to pass through it and be directed in either a forward, an upward, or a forward and upward direction.

Figure 2:
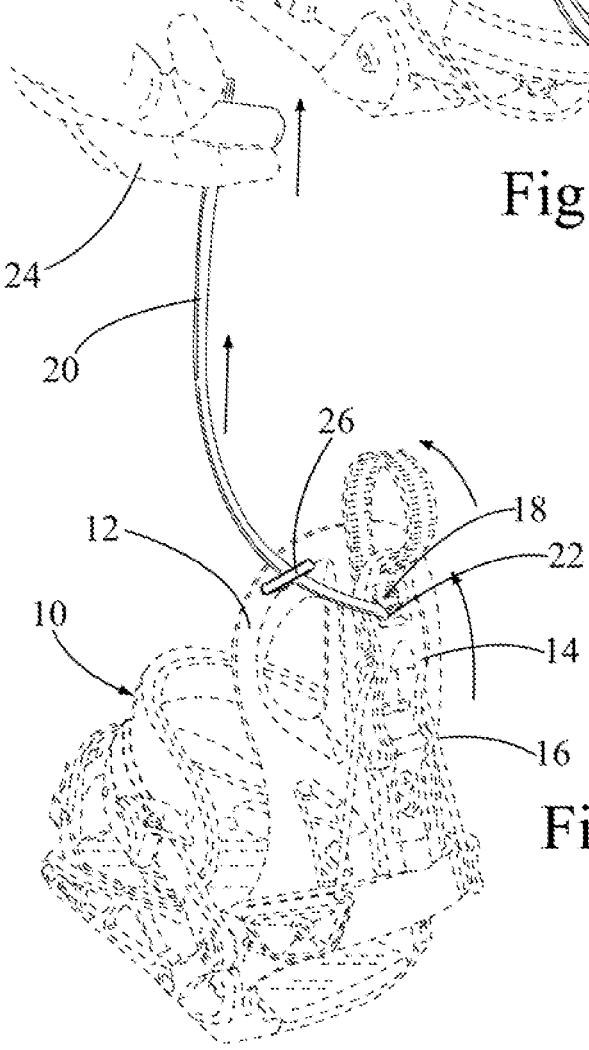
FIG. 2 is a diagram that illustrates an isometric perspective view of a snowboard binding with rear-mounted lever in the locked position with a pull cable, according to an embodiment of the present disclosure.

Referring to FIG. 2, this a diagram illustrates the same binding and embodiment of the invention as FIG. 1, except that it illustrates a hand (24) pulling the pull cable (20) in a forward and upward manner, thereby closing the locking lever (14), in accordance with an embodiment of the present disclosure.

Still referring to FIG. 2, important is that a snowboarder trying to close the locking lever on a binding is often balancing on his heels or toes while on a slope. Stooping down and reach behind a binding highback while balancing on one's heels or toes is difficult: the farther a snowboarder must reach, the more likely he/she is to lose his/her balance and fall over.

Referring back to FIG. 1 and still referring to FIG. 2, these diagrams illustrate several features, in accordance with an embodiment of the present disclosure. Firstly, the pull cable (20) can be semi-rigid; this allows the pull cable (20) to maintain an upright position against gravity; this in-turn allows the snowboarder to grasp the grip of the pull cable (24) from a position that is higher than the location of the cable guide (26) on the highback (12) of the binding. If the pull cable (20) being semi-rigid was not rigid enough to easily support its own weight and maintain itself in an upright position it would fall below the height of the cable guide (26) and highback (12) and thereby impairing the user's ability to grasp the grip (24) easily. Additionally, if the pull cable (20) were too rigid it would become prone to damage and could cause injury to the user.

Still referring back to FIG. 1 and still referring to FIG. 2, secondly, the cable guide (26) is located asymmetrically to the vertical axis of the highback (12) on the upper end of the highback. This feature allows the portion of the pull cable (20) that protrudes above the cable guide (26) when the rear-mounted locking lever (14) is in the down position to protrude forward, to the side, or past the leg of the user; toward the reaching hand of the user while the user crouches or leans downward.

Still referring back to FIG. 1 and still referring to FIG. 2, step-in bindings function by utilizing a rear-mounted locking lever that engages a cable connecting the pivotable sidewalls attached to a sole plate, such that the assembly simultaneously moves the highback and the instep straps, or other forward locking mechanism, into position about a rider's boot. Because the instep straps, or other forward locking mechanism, and highback are tightened simultaneously; there is less resistance against the highback when the foot is flexed upwards towards the shin of the user. Snowboarders are often balancing on their heels with their front side facing down the slope. Because a snowboarder is balancing on his heels, when he leans forward or crouches directly downward, his feet naturally curl upwards toward his shins; thereby allowing the locking lever of the binding to be placed in the locked position with less resistance. Because there is less resistance to the closure of the binding when pulling directly up or forward from the snowboarder's center of balance, less force is required. Because less force is required, the movement is quicker and the snowboarder is less likely to lose balance. This same principle applies whether the snowboarder is balancing on the toe side or heel side of the snowboard. This same principle also allows the present embodiments of the present disclosure to allow the snowboard to fasten their binding without sitting down.

Still referring back to FIG. 1 and still referring to FIG. 2, when the pull cable (20) is located above the cable guide (26) and to the side of the leg, the snowboarder will pull the pull cable (20) directly upwards, or forwards, or upwards and forwards from his center of balance, at a higher position than reaching for the locking lever without the aid of the embodiments of the claimed invention. While the snowboarder is in motion on a ski slope, he can gently reach to a convenient location for the pull cable; thereby allowing him to easily secure the binding while maintaining balance in an upright position.

Still referring back to FIG. 1 and still referring to FIG. 2, the performance benefits are clear when considering the alternatives. When balancing on a snowboarder's heels or toes, it is more difficult to grasp a pull cable that is behind the foot on the highback than it is to grasp a cable or cord that is raised higher and to the side, or in front of the leg; likewise, without a grip that one can pull directly upward or forward from one's center of gravity, maintaining one's balance becomes much more difficult. Reaching down and behind a snowboarder's leg to operate the locking lever additionally causes extension in the angle between the foot and the ankle, creating resistance on the highback that makes it much harder to close the locking lever. Extension between the foot and the ankle further increases the likelihood the snowboarder will lose his balance and not be able to secure his boot to his binding without sitting down.

Still referring back to FIG. 1 and still referring to FIG. 2, thirdly, the asymmetrical location of the cable guide (26) on the highback (12) acts as a pivot point for the pull cable (20), thereby decreasing the force necessary for the snowboarder to lock the rear-mounted lever (14). Again, the easier it is for the snowboarder to close the locking lever, the more likely that he will maintain his balance.

Still referring back to FIG. 1 and still referring to FIG. 2, fourthly, the asymmetrical location of the cable guide (26) allows the semi-rigid pull cable (20) to be pulled directly upward or forward while the snowboarder maintains their center of gravity without causing the pull cable to rub against the user's leg causing discomfort or wear to their clothing.

Still referring back to FIG. 1 and still referring to FIG. 2, fifthly, the pull cable (20) can, and preferably is (when installed as a post market add-on to common step in bindings as opposed to built into the binding at the factory), threaded through the aperture (18) in the rear-mounted locking lever (14) and over the top of the locking lever when it is in the locked position as shown in FIGS. 1 and 2. This provides several benefits: (a) it creates a second pivot point on the top of the locking lever thereby decreasing the force necessary for the user to lock the rear-mounted lever (14); (b) it prevents a pull cable from preventing the closure of the locking lever by coming between the locking lever and the highback; and (c) counter-intuitively, the pivot point (16) of the locking lever (14) itself aids in the closing of the locking lever until the locking lever crosses the horizontal plane at which point the force necessary to close the locking lever also increases due to the resistance felt as the binding secures the boot, having the pull cable loop over the thickness of the locking lever allows the pull cable (20) to create an angle between the pivot (16) of the locking lever (14) and the pivot point of the cable guide (26) that achieves greater mechanical advantage.

Figure 3:
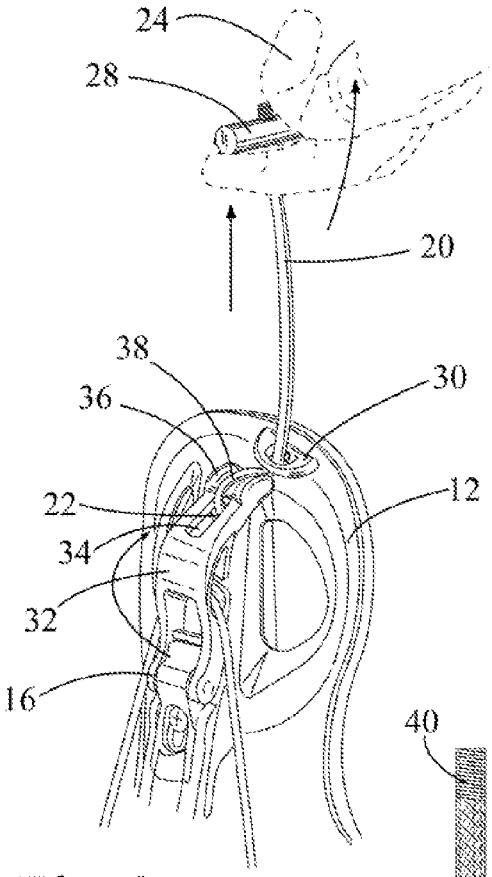
FIG. 3 is a diagram that illustrates an isometric perspective view of a snowboard binding with bent rear-mounted lever with a cable channel in the unlocked position with a pull cable, according to an embodiment of the present disclosure.

Referring to FIG. 3, this diagram illustrates a perspective view of an alternate embodiment similar to the embodiment in FIGS. 1 and 2, with a few new features, in accordance with the present disclosure. One of these features is that the locking lever (32) is bent above its hinge (16). The bend in the locking lever (32) allows the pull cable (20) to be channeled more directly into the cable guide (30), changing the point of wear on the locking lever from the side of the locking lever to its top. In the alternative, the locking lever could be straight without a bend, but installed with a hinge that is angled toward the cable guide, which would reduce angular tension on the locking lever's hinge, directing tension along the axis perpendicular to the axle of the hinge, thereby reducing wear on the axle of the hinge (16).

Still referring to FIG. 3, the use of a lever (32) that has a bulbous distal end (36) that serves the same function that the threading of the pull cable (20) over the locking lever serves, as explained above. This bulbous distal end (36) can have a channel running around its outward facing curve (38) that can cradle the pull cable (20) and keep it pointed towards the cable guide (30). In the alternative, the embodiment could include a locking lever (32) with an aperture (34) adapted to hold the end of the pull cable (20) at an ideal angle to prevent wear on the pull cable from repeated use. FIG. 3 also illustrates an alternative bar cable handle (28).

Figure 4:
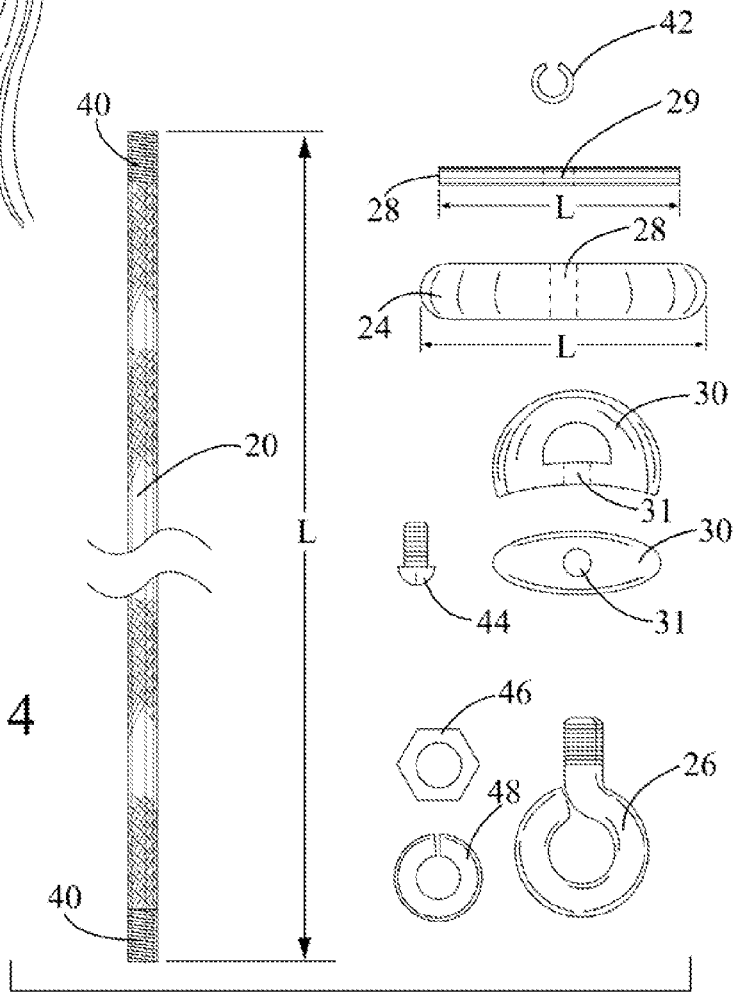
FIG. 4 is a diagram that illustrates various parts used to attach a pull cable to a binding according to embodiments of the present invention.

Referring to FIG. 4, this diagram illustrates a side exploded view of the cable or pull, in accordance with an embodiment of the present disclosure. Contemplated is that the cable or pull could be made and sold as an aftermarket accessory that users can install onto existing snowboard bindings. The cable or pull is so designed that it can either be built into the binding or installed as an aftermarket add-on and possibly still be quickly and easily moved from one binding to another. The parts that may be used include: a pull cable (20) which may optionally have threaded regions on either end (40); handles such as a rounded disk (24), or a bar handle (29), with a region for attachment (28) that can accommodate the pass through of pull cable (20), the grip then attached to the semi-rigid pull cable by use of crimps (42) or by allowing the semi-rigid pull cable to screw directly into the grip. Depicted are two examples of a cable guide, including a stylized version that is lower profile and therefore less likely to cause injury (30), with a screw (44), and a threaded socket (31). In FIG. 4 one can also find a cable guide assembled from a standard threaded ring (26), nut (46), and washer (48) closure.

2. Method for Attaching the Pull Cable Depicted in FIGS. 1 T*hrough* 4

Referring back to FIGS. 1 through 4, if a cable guide is not molded directly into the highback of the binding, the embodiments of this invention can easily be installed in virtually any snowboard binding with a rear-mounted locking lever containing an aperture with as little as two simple steps. First, drill a hole into the highback of the binding and insert a screw (44) through the highback and into a cable guide (30). Second, thread a semi-rigid pull cable (20) with a crimped (42), or otherwise secured, end through the inside of the aperture of the locking lever then through the cable guide (30). Finally, attach the grip (28) to the semi-rigid pull cable if necessary.

3. Using the Semi-Rigid Pull Cable as a Means to Carry a Snowboard

In one alternative embodiment of the present disclosure (not shown), the pull cables or straps have loops on their upward ends in place of, or in addition to, handles. Such loops are ideally placed to allow the user to carry their snowboard by placing such loops around their shoulders. Carrying the snowboard with such loops allows the board to be carried with the bindings opened and the flat of the bottom of the board against the flat of the user's back or front.

4. Using a Semi-Rigid Bendable Guide for a Pull Cable

Figure 5:
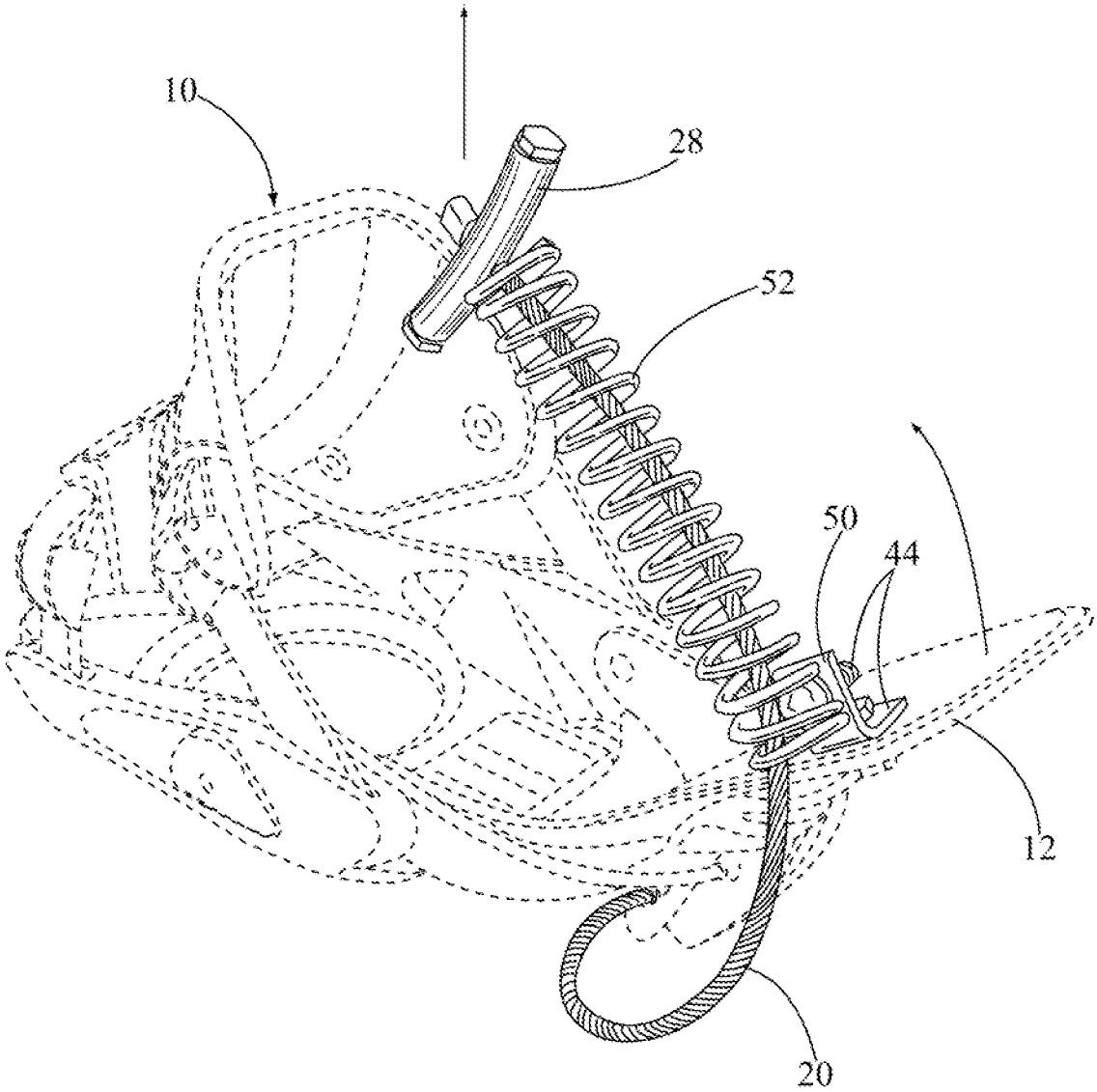
FIG. 5 is a diagram that illustrates an isometric perspective view of a snowboard binding with a semi-rigid bendable guide and mounting bracket, according to an embodiment of the present disclosure.

Referring to FIG. 5, this diagram illustrates a pull or cable that includes a semi-rigid bendable guide (52), such as a spring, in accordance with an embodiment of the present disclosure. The semi-rigid bendable guide (52) is attached to the highback (12) with a bracket (50). In this embodiment, the pull cord (20) has less reason to be semi-rigid as the semi-rigid bendable guide can guide the pull cord or strap to a position upward, forward, or upward and forward from the highback (12) of the binding. As illustrated, this embodiment accomplishes attaching the semi-rigid bendable guide (52) to the highback with one screw (44) which attaches a bracket (50) to the highback (12), and a second screw (44) which attaches the bracket (50) to the semi-rigid bendable guide (52). The semi-rigid bendable guide (52) is attached in such a way that it is directed upwards, forwards, or upwards and forwards towards the hands of the snowboarder, situated between the grip (28) and the highback (12). In alternative embodiments, the bracket (50) can be: an L-bracket, a straight bracket, a hinge; the semi-rigid bendable guide can also be molded to the highback (12), slot or snap into place, or any other suitable method of fixing the semi-rigid bendable guide (52) to the highback (12), with any number of screws or other articles or methods of attachment. The semi-rigid bendable guide bends to allow the rider to continue to pull the pull cord (20) in the upward plain as the rider stands upward, thereby allowing the rider to more easily maintain their balance and not have to sit down.

Figure 6:
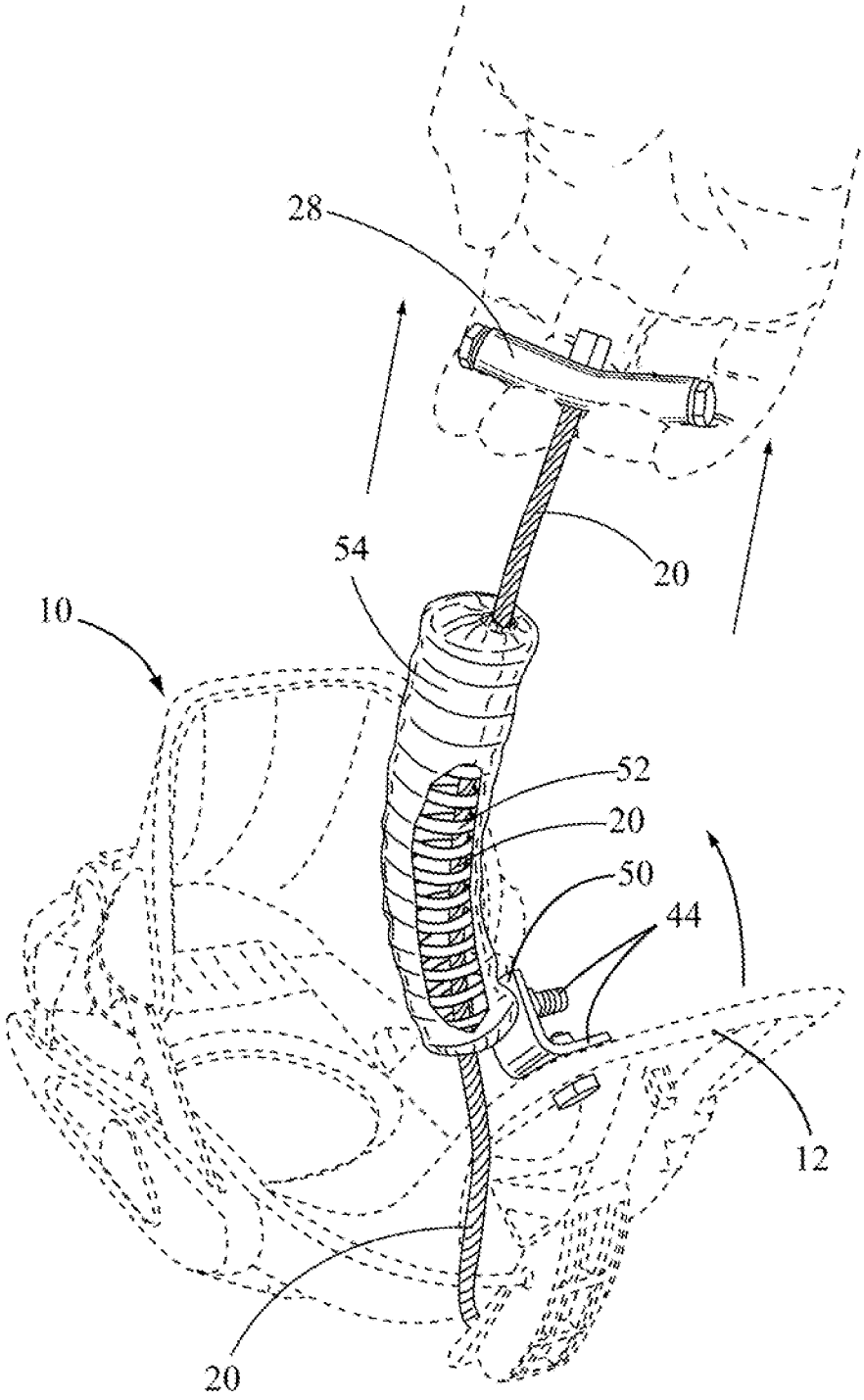
FIG. 6 is a diagram that illustrates an isometric perspective view of a snowboard binding with an angled semi-rigid bendable guide and semi-rigid bendable guide cover, according to an embodiment of the present disclosure.

Referring to FIG. 6, this diagram illustrates a pull or cable that includes a semi-rigid bendable guide cover (54) over a curved semi-rigid bendable guide (52) and a hand pulling upwards on the grip (28), in accordance with an embodiment of the present disclosure. The semi-rigid bendable guide cover (54) prevents the semi-rigid bendable guide (52) from becoming packed up with ice, snow, or mud so that the pull cable (20) continues to glide effortlessly inside the semi-rigid bendable guide (54). The angle of the semi-rigid bendable guide (52) can help to place the grip in a forward and inward position because it can slightly angle around the snowboarder's leg. The angled semi-rigid bendable guide (52) feature makes it even easier for the snowboarder to grasp the grip while maintaining a balanced position. Furthermore, the semi-rigid bendable guide (52) can also act as a guide to direct the boot into the binding before the snowboarder is ready to close the locking lever, whereby the snowboarder need not even look down to find the correct horizontal position of the foot for placing it within the binding.

5. Storing the Pull Cable Against the Binding

Figure 7:
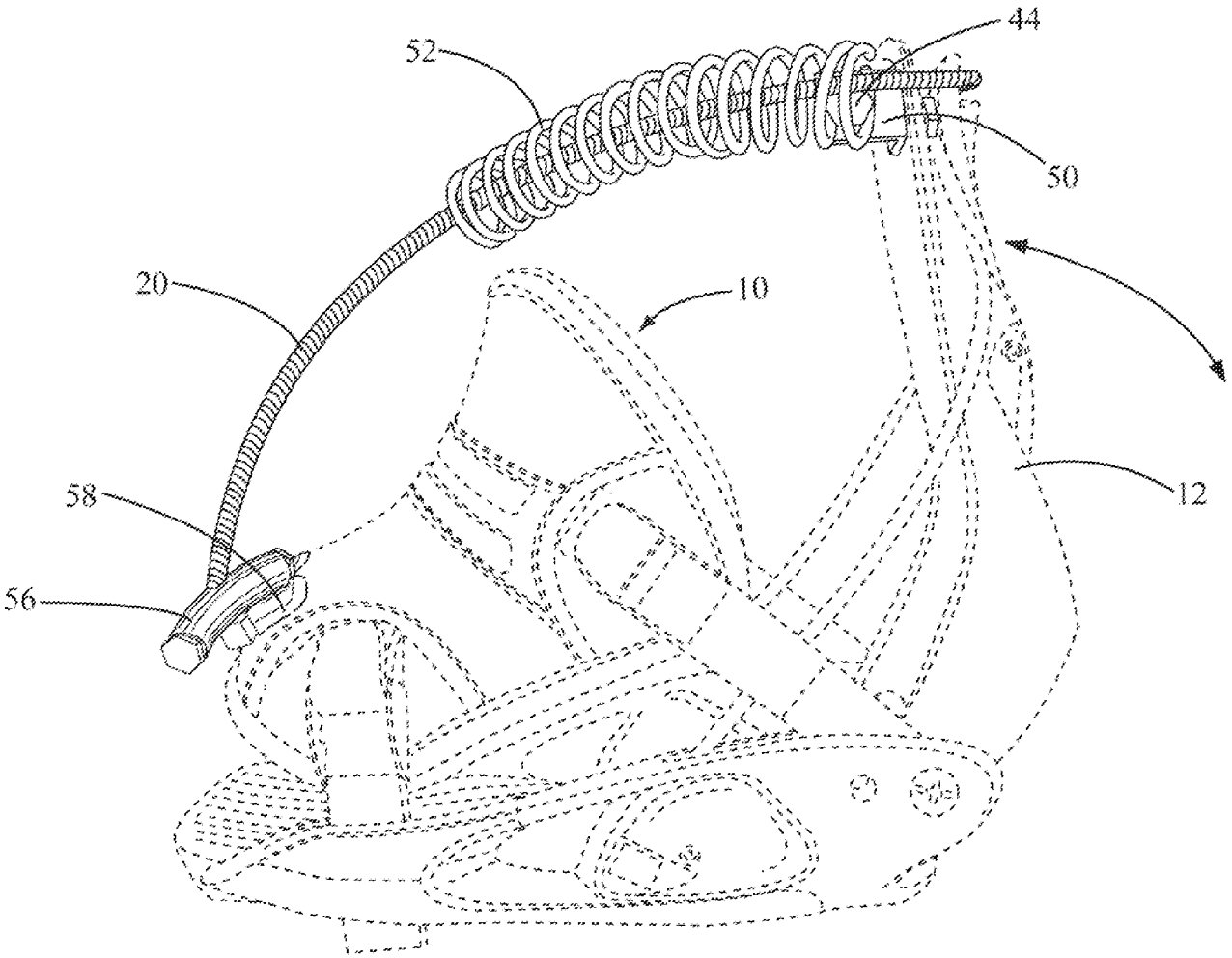
FIG. 7 is a diagram that illustrates an isometric perspective view of a snowboard binding with an angled semi-rigid bendable guide, and the grip stored against the toe end of the binding, according to an embodiment of the present disclosure.

Referring to FIG. 7, this diagram illustrates a pull or cable that includes a means to attach the grip to the toe region of the binding (10), in accordance with an embodiment of the present disclosure. The grip (56) contains a magnetic material and another magnet (58) is positioned on the toe region of the binding (10) such that the grip (56) and the magnet (58) are attracted to each other. The magnetic attachment allows for the easy stowage of the pull cable when the snowboarder desires. The magnetic attachment also allows for the rider to more easily release the stored pull cable without having to take another unnecessary step to release the pull cable. In an alternative embodiment, the grip (56) can be stored in a slot located on the toe area of the binding (10).

All patents and publications are herein incorporated by reference to the same extent as if each individual publication was specifically and individually indicated to be incorporated by reference.

Understood is that, while certain forms of the present disclosure are illustrated, the subject matter of the present disclosure is not to be limited to the specific forms or arrangements herein described and shown. For example, a spring is used; however, in the alternative other semi-rigid bendable guides could be used, such as tubes, connected rigid pieces, etc. Various changes may be made without departing from the scope of the present disclosure; and the present disclosure is not to be considered limited to what is shown and described in the specification and any drawings/figures included herein.

One skilled in the art will readily appreciate that the subject matter of the present disclosure is well-adapted to carry out the objectives and obtain the ends and advantages mentioned, as well as those inherent therein. The embodiments, methods, procedures, and techniques described herein are presently representative of the preferred embodiments; are intended to be exemplary; and are not intended as limitations on the scope. Changes therein and other uses will occur to those skilled in the art which are encompassed within the spirit of the invention and are defined by the scope of the claims. Although the present disclosure has been described in connection with specific preferred embodiments, understood is that the subject matter of the present disclosure as claimed should not be unduly limited to such specific embodiments. Indeed, various modifications of the described modes for carrying out the subject matter of the present disclosure which are obvious to those skilled in the art are intended to be within the scope of the claims.

What is claimed is:

1. A pull cable for closing a rear-mounted locking lever located on a highback of a binding, the pull cable comprising:

a cable guide comprising a semi-rigid bendable guide; and a pull cable having a first end attachable to the rear-mounted locking lever and a second end extendable through the cable guide, wherein, the second end is capable of extending through the cable guide forward from the highback of the binding, and wherein the pull cable is adapted to move the rear-mounted locking lever from an open to a closed position when the pull cable is attached to the rear-mounted locking lever and is pulled upon.

2. The pull cable of claim 1, wherein the pull cable is semi-rigid.

3. The pull cable of claim 1, further comprising a grip.

4. The pull cable of claim 3, wherein the grip comprises a loop.

5. The pull cable of claim 4, wherein the loop can be placed around a shoulder.

6. The pull cable of claim 3, wherein the grip comprises a bar.

7. The pull cable of claim 6, further comprising a slot on the binding into which the bar can be secured.

8. The pull cable of claim 3, wherein the grip comprises a magnetic material.

9. The pull cable of claim 8, further comprising a magnetic material on the binding to which the grip can be secured.

10. The pull cable of claim 1, wherein said cable guide is molded into said highback of said binding.

11. The pull cable of claim 1, wherein said cable guide is removably attached to said highback of said binding.

12. The pull cable of claim 1, wherein said semi-rigid bendable guide is curved.

13. The pull cable of claim 1, wherein said semi-rigid bendable guide is attached to said highback of said binding with a bracket.

14. The pull cable of claim 1, further comprising a semi-rigid bendable guide cover.

15. A method of closing a rear-mounted locking lever located on a highback of a binding, the method comprising:

placing a boot in a binding with a locking lever in an open position; and pulling a pull cable through a cable guide located on the highback of the binding from a position forward of the highback of the binding, the cable guide comprising a semi-rigid bendable guide, thereby closing the lever.

16. The method of claim 15, further comprising securing the pull cable to the binding once the lever is closed.

17. A method of attaching a pull cable to a binding with a rear-mounted locking lever located on a highback of said binding, the method comprising:

attaching the pull cable to the rear-mounted locking lever;

attaching a pull cable guide to the highback of the binding, the cable guide comprising a semi-rigid bendable guide; and disposing the pull cable through the pull cable guide, thereby extending the pull cable forward of the highback of the binding.

18. The method of claim 17, further comprising attaching a grip to the pull cable.

* * * * *